US005603183A

United States Patent [19]

Giovinazzi

[11] Patent Number: 5,603,183

[45] Date of Patent: Feb. 18, 1997

[54] WINDOW SECURITY DEVICE

[76] Inventor: Thomas Giovinazzi, 1131 Hancebridge Rd., Millville, N.J. 08332

[21] Appl. No.: 621,639

[22] Filed: Mar. 26, 1996

[51] Int. Cl.[6] ..... E06B 3/68; E06B 9/02

[52] U.S. Cl. ..... 49/56; 49/55; 49/57

[58] Field of Search ..... 49/55, 56, 57; 52/101

[56] References Cited

U.S. PATENT DOCUMENTS

| | | | |
|---|---|---|---|
| 1,142,403 | 6/1915 | Davis | 49/56 |
| 1,607,066 | 12/1926 | English | 49/56 |
| 1,855,865 | 4/1932 | McWane | 49/56 |
| 2,195,291 | 3/1940 | Zukor | 49/56 |
| 3,167,828 | 2/1965 | Hutchisson | 49/57 |
| 4,059,413 | 11/1977 | Forgione | 49/56 |
| 4,400,912 | 8/1983 | Wicks, Sr. | 49/56 |
| 5,461,827 | 10/1995 | Lofton | 49/56 |

*Primary Examiner*—Brian K. Green
*Assistant Examiner*—Curtis A. Cohen
*Attorney, Agent, or Firm*—Brady, O'Boyle & Gates

[57] ABSTRACT

A window security device wherein a window bar assembly is slidably mounted in a frame assembly secured to the interior surface of a wall in which the window is mounted. A releasable fastener is connected between the bar assembly and the frame assembly for holding the bar assembly in an operative position across the window and releasable to allow the bar assembly to slide downwardly to an inoperative position away from the window. When in the inoperative position, the bar assembly provides a ladder to facilitate exit through the window in case of an emergency. When in the operative position, the bar assembly extends over fasteners securing the frame assembly to the wall to prevent access to the fasteners.

6 Claims, 5 Drawing Sheets

WINDOW SECURITY DEVICE

BACKGROUND OF THE INVENTION

Various security devices have been provided for windows to prevent intruders from entering the building through the windows. Most of these devices consist of a grill or a frame of bars fixedly connected to the window frame in which the window is mounted. Some security devices are detachably connected to the window frame to provide authorized access to the building through the window, or to facilitate cleaning the window.

While these window security devices have been generally satisfactory for their intended use, they have been subject to certain disadvantages. For instance, the mounting assembly for securing the security device to the window is usually accessible to the intruder so that it can be easily removed from the window, and when installed on a basement window, which is usually some distance above the basement floor, an emergency exit through the window after the security device has been removed requires the use of a ladder.

SUMMARY OF THE INVENTION

After considerable research and experimentation, the window security device of the present invention has been devised to overcome the disadvantages experienced in heretofore employed window security devices, and comprises, essentially, a plurality of spaced, parallel, vertically extending window bars held in spaced relationship by a pair of transversely extending plate members, one plate member being integrally connected to the lower ends of the bars and the other plate member being integrally connected to the bars intermediate the upper and lower ends of the bars. A first angle iron is fastened to the interior surface of a wall in which the window is mounted at a distance well above the window, and a second angle iron is fastened to the wall at a distance well below the window, whereby an intruder cannot reach through the open window and remove the angle iron wall fasteners. Apertures are provided in the horizontal flange of each angle iron through which the window bars are slidably mounted. A transversely extending tubular member is secured to the wall above the second angle iron. The peripheral wall of the tubular member is provided with aligned apertures through which the window bars are slidably mounted, whereby the window bars are guided by the tubular member during the raising and lowering of the window bars. The horizontal flange of the second angle iron is positioned above the transversely extending plate member at the lower end of the window bars, and a releasable fastener is provided therebetween for holding the window bars in the up position across the window. When released, the window bars slide downwardly through the horizontal flanges of the angle irons and apertures of the tubular member to uncover the window. If the window is positioned a distance somewhat above the floor, such as a basement window, the transversely extending plate members and associated bars provide a ladder to facilitate an exit through the window in case of an emergency.

DESCRIPTION OF THE PREFERRED EMBODIMENTS

Figure 1:
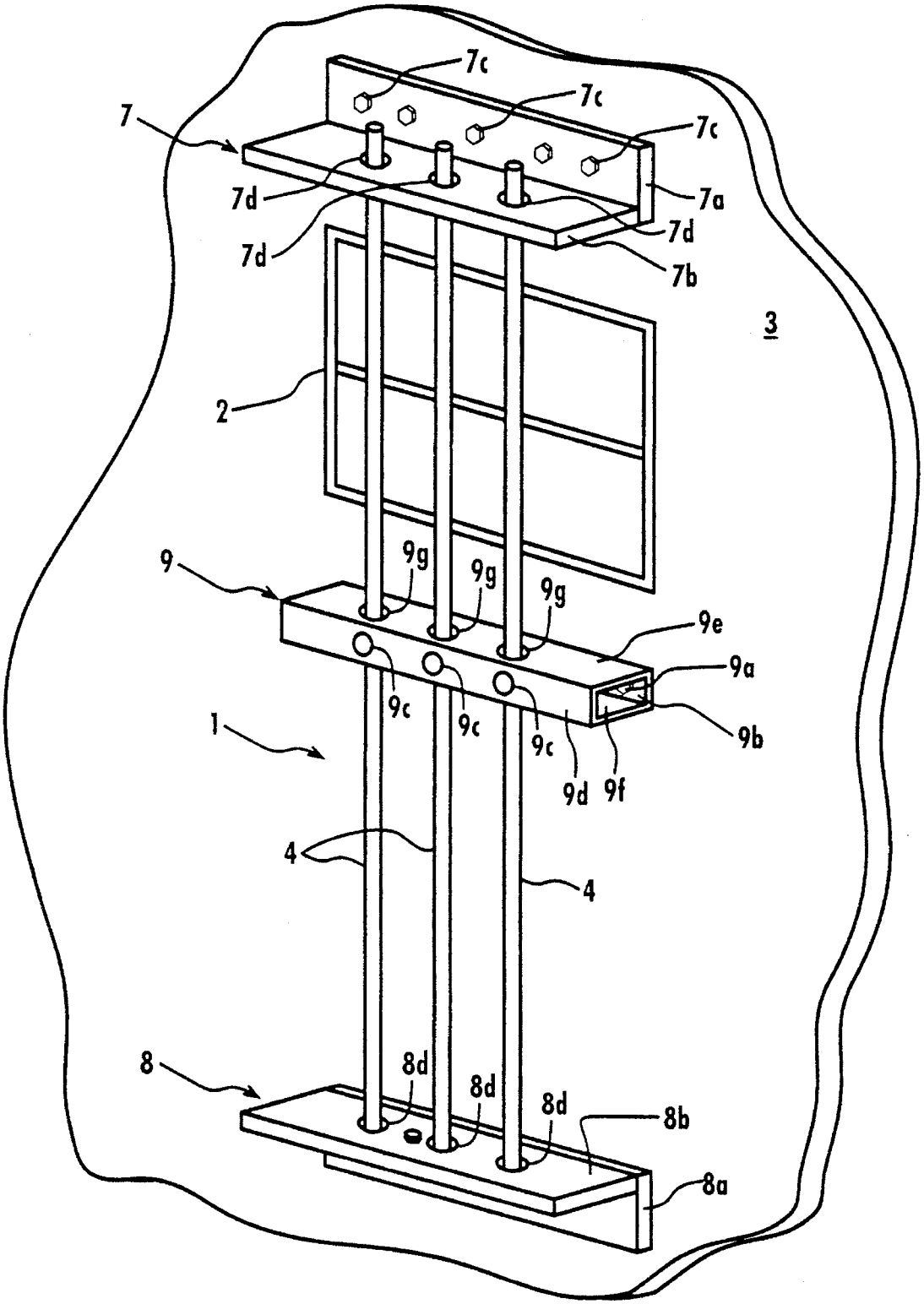
FIG. 1 is a perspective view of the window security device of the present invention in the operative position.
Figure 2:
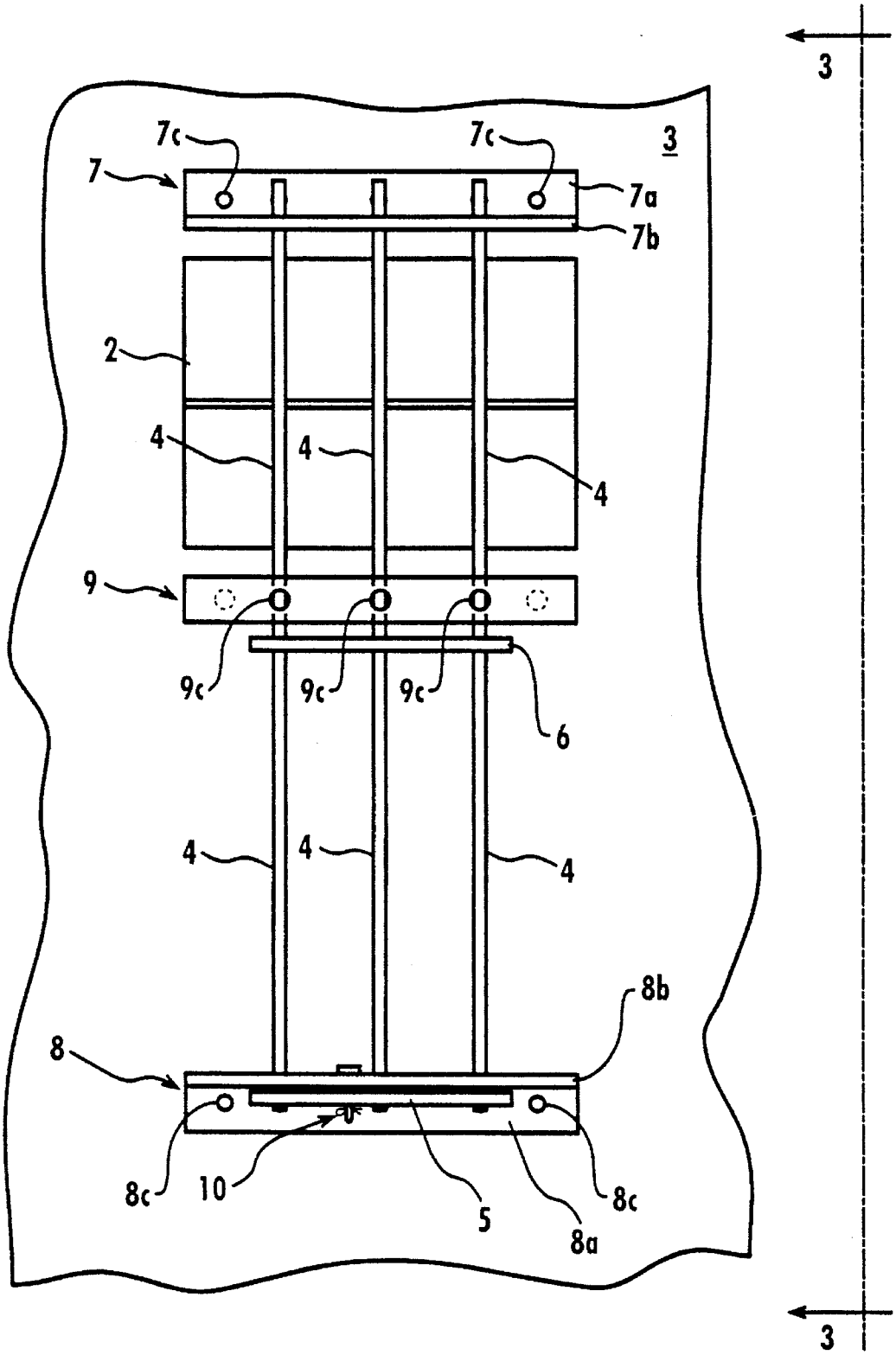
FIG. 2 is a front elevational view of the device shown in FIG. 1.
Figure 3:
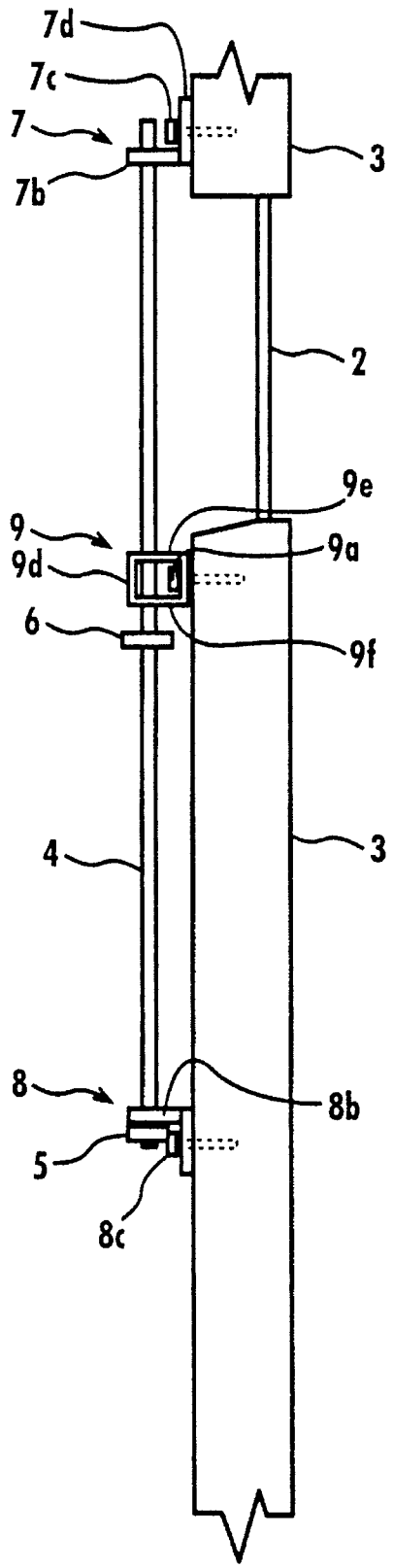
FIG. 3 is a view taken along line 3—3 of FIG. 2.

Referring to the drawings and, more particularly, to FIGS. 1, 2, and 3, the window security device 1 of the present invention is adapted to cover a window 2 mounted in a wall 3 of a building, such as a house, and comprises a plurality of spaced, parallel, vertically extending window bars 4 held in spaced relationship by a pair of transversely extending plate members 5 and 6, respectively connected to the lower ends of the bars 4 and intermediate the upper and lower ends of the bars 4.

A first angle iron 7 having a vertical flange 7*a* and a horizontal flange 7*b* is secured to the interior surface of wall 3 above the window 2 by suitable fasteners such as bolts 7*c* extending through the vertical flange 7*a* and into the wall 3. Similarly, a second angle iron 8 having a vertical flange 8*a* and a horizontal flange 8*b* is secured to the wall 3 below the window 2 by suitable fasteners, such as bolts 8*c* extending through the vertical flange 8*a* and into the wall 3. Apertures 7*d* and 8*d* are provided in the horizontal flanges 7*b* and 8*b* of the angle irons 7 and 8 through which the window bars 4 are slidably mounted. As will be seen in FIG. 2, when in the operative position covering the window 2, the upper and lower ends of the bars 4 extend over some of the angle iron fastening bolts 7*c* and 8*c*, so that an intruder cannot reach the bolts 7*c* and 8*c* to remove the angle irons 7 and 8 when the window 2 is open.

An open-ended tubular member 9 having a rectangular cross-section is positioned above the angle iron 8 and below the window 2 and fastened to the wall 3 by a plurality of bolts 9*a* extending through the rear wall 9*b* of the tubular member 9. Access to the inboard bolts 9*a* is provided with access holes 9*c* provided in the front wall 9*d* of the tubular member 9, and access to the outboard bolts 9*a* is through the open ends of the tubular member 9. As the angle iron fasteners 7*c* and 8*c* are covered by the bars 4 when the security device 1 is in the operative position, so too are the inboard fasteners 9*a* for the tubular member 9. The top wall 9*c* and bottom wall 9*f* of the tubular member 9 are provided with aligned apertures 9*g* through which the window bars 4 are slidably mounted, whereby the bars 4 are guided by the tubular member 9 during the raising and lowering of the security device 1.

Figure 4:
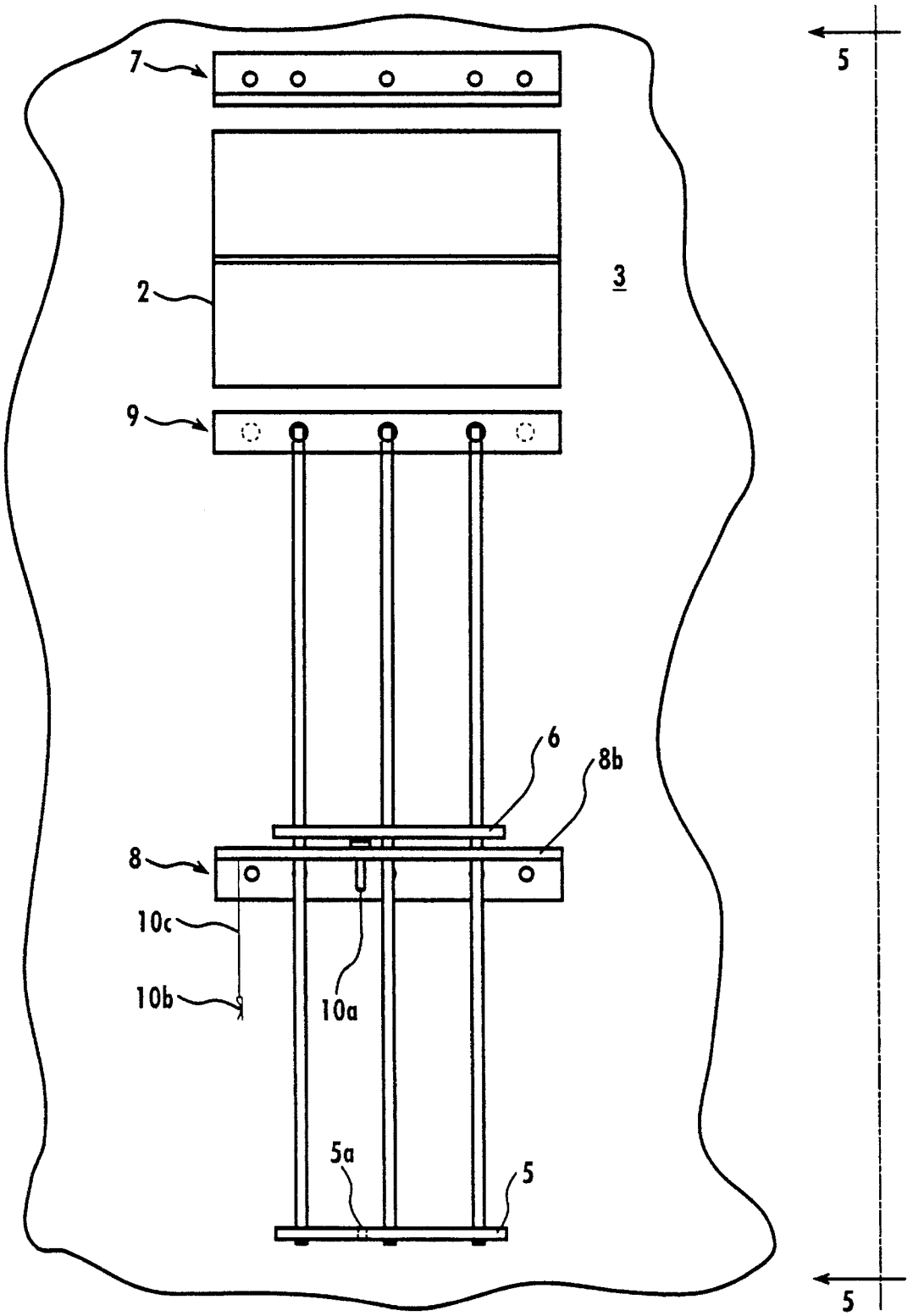
FIG. 4 is a front elevational view of the device shown in FIG. 2 released to the open or window uncovering position.
Figure 5:
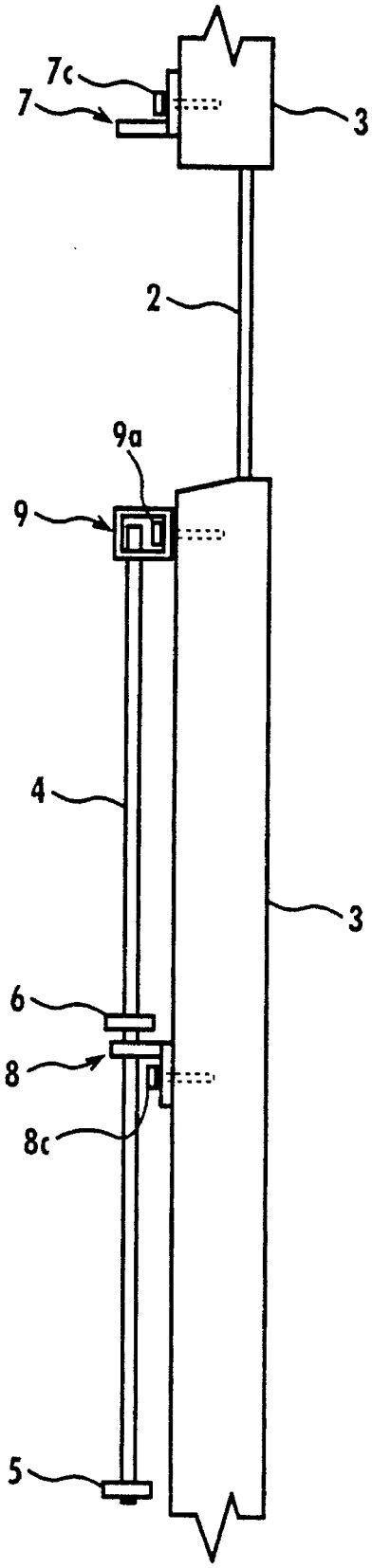
FIG. 5 is a view taken along line 5—5 of FIG. 4.

As will be seen in FIG. 2, the horizontal flange 8*b* of the lower angle iron 8 is positioned above the transversely extending plate member 5 at the lower ends of the bars 4, and a releasable fastener 10 is provided between the transverse plate 5 and the flange 8*b* for holding the security device 1 in the up position across the window 2. As will be seen in FIG. 4, the fastener 10 of FIG. 2 comprises a depending bolt 10*a* extending downwardly through the horizontal flange 8*b* of the lower angle iron 8, and insertable through an aperture 5*a* provided in the lower transverse member 5. A spring clip 10*b*, tethered as at 10*c* to the horizontal flange 8*b*, is provided for engaging the bolt 10*a* and lower surface of the transverse member 5 for holding the security device 1 in the operative position across the window 2 as shown in FIGS. 1, 2, and 3. When it is desired to move the security device to an inoperative position, the spring clip 10*b* is pulled away from the bolt 10*a* and the bars 4 slide downwardly away from the window 2, as shown in FIGS. 4 and 5. If the window 2 is mounted in a basement, it will be somewhat of a distance above the basement floor requiring the use of a ladder to exit through the window 2 in case of an emergency. The transverse members 5 and 6 and associated bars 4 provide the needed ladder when the security device is in the lower position.

From the above description, it will be readily appreciated by those skilled in the art that the window security device of the present invention is an improvement over heretofore employed security devices in that the window bars can be easily moved from an operative position across a window to a lowered position away from the building, and, while in the lowered position, the bars 4 and associated transverse plates 5 and 6 provide a ladder to facilitate an exit through the window in case of an emergency. Furthermore, the construction and arrangement of the window bars 4, and the angle irons 7 and 8 and tubular member 9, is such that the bars 4 extend over the angle iron fasteners 7*c*, 8*c*, and tubular member fasteners 9*a* to prevent access to the fasteners when the security device 1 is in the operative position.

It is to be understood that the forms of the invention herewith shown and described are to be taken as preferred examples of the same, and that various changes in the shape, size, and arrangement of parts may be resorted to, without departing from, the spirit of the invention or scope of the subjoined claims.

I claim:

1. A window security device comprising, a plurality of spaced, parallel, vertically extending bars, a pair of spaced, parallel, transversely extending plate members integrally connected to the bars for holding said bars in said spaced, parallel, vertically extending relationship, a wall, a window mounted in said wall, a first frame member, fastening means securing said first frame member to said wall above said window, a second frame member, fastening means securing said second frame member to said wall below said window, apertures provided in said first and second frame members, a upper end portion of the bars being slidably mounted in the apertures in said first frame member, a lower end portion of said bars being slidably mounted in the apertures in the second frame member, and releasable fastening means connected between one of said transversely extending plate members and the second frame member for holding the bars in an operative position across said window and when released allowing said bars to slide downwardly through said frame members to an inoperative position away from said window, said bars extending over said fastening means for said first and second frame member when the bars are in the operative position, to thereby prevent access to said fastening means, the bars and associated transverse plate members providing a ladder when the bars are in the inoperative position, to thereby facilitate an exit through the window in case of an emergency.

2. A window security device according to claim 1, wherein a transversely extending tubular member is mounted on the wall below the window and above the second frame member, apertures provided in said tubular member, the bars being slidably mounted in said apertures, whereby the bars are guided by the tubular member during the raising and lowering of the bars.

3. A window security device according to claim 1 wherein the first and second frame members each comprise a right angle member having a vertically extending flange and a horizontally extending flange, said fastening means extending through said vertically extending flanges, and said apertures being formed in said horizontally extending flanges.

4. A window security device according to claim 3, wherein one of said transversely extending plate members is connected to the lower end portions of said bars and positioned below the horizontal flange on the second frame member, said releasable fastening means comprising a bolt mounted on the horizontal flange of said second frame member and depending downwardly therefrom, an aperture in said one transversely extending plate member, said depending bolt extending through said aperture, and a transversely extending spring clip engaging said bolt beneath the lower surface of said horizontal flange for holding the bars in the operative position across the window.

5. A window security device according to claim 2 wherein the tubular member is open ended and has a rectangular cross-section providing a front wall, a back wall, a top wall, and a bottom wall, first apertures provided in said back wall, fastening means extending through said first apertures for securing the tubular member to said wall, second apertures provided in said front wall aligned with the apertures in said back wall for providing access to some of the fastening means securing the tubular member to said wall, access to other of said fastening means being provided by the open ends of said tubular member, and aligned apertures in said top and bottom walls through which the bars are slidably mounted.

6. A window security device according to claim 1 wherein the window is mounted in a basement wall at a distance well above a basement floor.

* * * * *